United States Patent [19]

Stewart et al.

[11] Patent Number: 4,672,262

[45] Date of Patent: Jun. 9, 1987

[54] ELECTRON BEAM INJECTION STRUCTURE FOR FLAT PANEL DISPLAY DEVICES

[75] Inventors: Wilber C. Stewart, East Windsor; Leon J. Vieland, Princeton, both of N.J.

[73] Assignee: RCA Corporation, Princeton, N.J.

[21] Appl. No.: 757,666

[22] Filed: Jul. 22, 1985

[51] Int. Cl.[4] ..... H01J 29/72

[52] U.S. Cl. ..... 313/422; 315/366

[58] Field of Search ..... 313/422; 315/366

[56] References Cited

U.S. PATENT DOCUMENTS 4,069,439 1/1978 Anderson ..... 313/422
4,128,784 12/1978 Anderson ..... 313/422
4,263,529 4/1981 Siekanowicz ..... 313/422
4,359,671 11/1982 Gange ..... 315/366

*Primary Examiner*—Palmer C. DeMeo
*Assistant Examiner*—Sandra L. O'Shea
*Attorney, Agent, or Firm*—E. M. Whitacre; D. H. Irlbeck; L. L. Hallacher

[57] ABSTRACT

An electron injection structure for the beam guide meshes of a flat panel display has apertures with different dimensions to optimize beam focusing for different purposes. The first period of apertures has strong focusing normal to the plan of the guide meshes. A plurality of periods have strong focusing in a direction parallel to the lateral dimension of the guide meshes. Another plurality of apertures matches the beams to the propagation section of the beam guide.

7 Claims, 12 Drawing Figures

ELECTRON BEAM INJECTION STRUCTURE FOR FLAT PANEL DISPLAY DEVICES

BACKGROUND

This invention relates generally to a flat panel display device having a plurality of electron guns for providing electron beams to electron beam guides and particularly to an electron beam injection structure for such a display device.

U.S. Pat. No. 4,128,784 to C. H. Anderson describes a beam guide for use in a flat panel cathodoluminescent display device. The display device is composed of an evacuated envelope containing a plurality of internal support walls which divide the envelope into a plurality of parallel channels. Each channel contains a beam guide extending along one wall of the envelope. An electron gun structure emits electrons which are launched into the beam guides as electron beams. The beam guides include a pair of spaced parallel ladder type meshes extending along and spaced from the backwall of the envelope. The meshes contain a plurality of apertures arranged in columns extending longitudinally along the paths of the beams. Each longitudinal column of apertures constitutes a separate beam guide. The apertures also are arranged in rows laterally across the width of the guide meshes. One line of the visual display is generated by ejecting the electron beams out of the guides of every channel through the apertures in a single row.

Display devices of the type described in the Anderson patent can be much larger than conventional cathode ray tubes. For example, a display having a 125 cm diagonal is contemplated. Such a display would have a 75 cm vertical dimension and a 100 cm horizontal dimension. Each electron beam, therefore, must propagate the full 75 cm dimension of the display area, as well as an additional distance in the gun area where the beams are injected into the beam guide.

The path of each electron beam from the cathode to the display screen can be divided into three distinct regions. The first is an injection region where electrons are drawn from a thermionic cathode and introduced into the guiding structure as beams. The second region is the beam guide proper where, ideally, the electrons propagate through periodic focusing fields along the beam guide axis with little or no change in beam size. At an extraction point, which can be at any period of the main guide, the beams are deflected out of the beam guide through one of the rows of apertures into the third region. This region is an accelerating, focusing, and deflection region which shapes the beam size and establishes the location where the beams impact the display screen.

The overall operation of a display device is improved by maximizing the percentage of emitted electrons which enter trajectories that are stable in the propagation region. The distribution of position coordinates and velocity vectors of the entering electrons typically do not have the form which is most satisfactorily propagated by a periodic focusing structure, and strong focusing must be used to achieve a high injection efficiency. However, optimum optical performance of the display is achieved by operating the periodic focusing structure at the weakest possible focus strength, which minimizes the visibility of wobble induced beam landing errors at the screen. Weak focusing also results in lower magnification of the beam image projected to the screen and higher resolution is obtained. However, for fixed beam injection conditions, lowering the focus strength of the guide results in poorer beam confinement, a loss in injection efficiency, and lower overall picture contrast, because of scattered electrons. For these reasons the operating parameters and beam guide geometry are compromises between the competing requirements of maximized electron injection and optimum propagation performance.

Efforts have been made to overcome these difficulties by placing a launch region between the electron injection region and the beam propagating region. One such effort is described in U.S. Pat. No. 4,263,529 to W. W. Siekanowicz, et al. This patent describes a flat panel display including multiple beam channels each of which encloses guide meshes extending along the length of the channels. Each channel includes modulation electrodes and a cathode to provide modulated electron beams to the guide meshes. The guide meshes extend between the modulation electrodes, and the electron beams are propagated along the channels in the space between the meshes. A plurality of pairs of launch electrodes are arranged to span the beam guide meshes. The conditions under which electrons are launched into the space between the guide meshes can be selected by the application of various biasing potentials to the pairs of launch electrodes. Accordingly, the conditions under which electrons are launched into the propagation space can be selected substantially independently of the conditions required for operation of the cathode and modulation electrodes, and of the focus voltage on the beam guides.

U.S. Pat. No. 4,359,671 to R. A. Gange also describes a flat panel display device which is devided into a plurality of channels, each of which includes beam guides and a cathode. A plurality of electrode pairs is arranged between the cathode and the beam guides. The application of various combinations of biasing potentials to the electrode pairs permits focusing of the electron beams prior to their injection between the beam guides, and allows the use of higher potentials to attract electrons from the cathode to maximize extraction of electrons from the cathode without affecting the optimum focusing required for propagation along the channels.

The structures described in U.S. Pat. Nos. 4,263,529 and 4,359,671 constitute improvements over display devices which do not utilize launch regions. However, both structures require additional electrodes in the display device and thus increase the complexity and cost of fabricating the display. Both devices also have operational disadvantages. In the Siekanowicz display, an increase in the potential on a pair of launch electrodes simultaneously increases the focusing through the associated guide apertures in both principal directions transverse to the propagation axis. In the Gange display, optimum injection is achieved in one aspect of the beam, but no provision is available for adjusting focus in the plane of the guides. According to the criteria set forth, and consistent with the details of the electron injection as given below, what is needed is a beam guide having optimum propagation focusing and which permits independent focus tailoring of the injected electron beam in all directions, without the need for a special launch section composed of special electrodes. The present invention fulfills these needs.

SUMMARY

An electron injection region for the beam guide structure in a flat panel display device has at least one period having aperture dimensions resulting in strong electron focusing in the direction of an axis normal to the plane of the beam guide meshes, and weak focusing in a direction parallel to the lateral dimension of the meshes. A first plurality of periods has aperture dimensions resulting in weak focusing along the axis normal to the plane of beam guide meshes, and strong focusing in the direction parallel to the lateral dimension. A second plurality of periods has aperture dimensions selected to duplicate the focusing conditions in the propagation section of the beam guide.

THEORY OF LADDER MESH ELECTRON BEAM GUIDES

Figure 1:
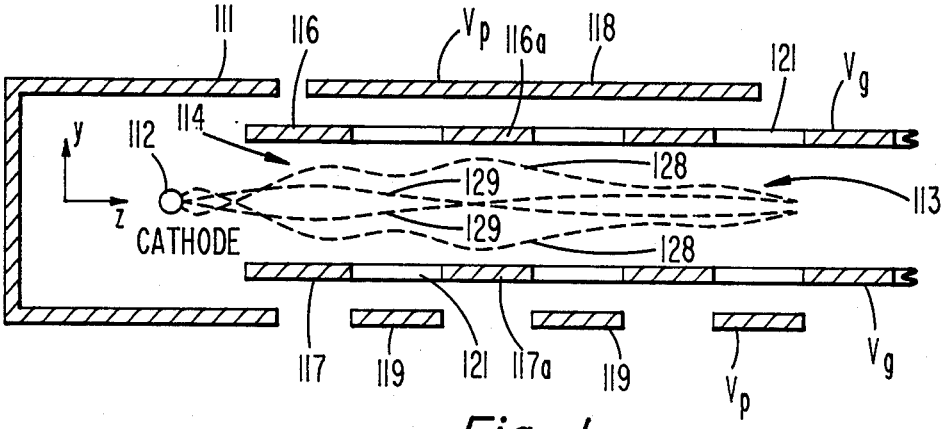
Fig. 1 PRIOR ART
FIG. 1 is a longitudinal section through a beam guide showing the configuration of the beam in the Y-Z, or vertical plane, for prior art beam guide meshes.

In the prior art, as illustrated in FIG. 1, a modulator electrode 111 surrounds a cathode 112 and is used to modulate an electron beam 113 with the display information. The beam 113 enters a space 114 between guide meshes 116 and 117, both of which are biased at the voltage $V_g$. The beam 113 is confined between the meshes 116 and 117 by balancing electric fields from a symmetric electrode 118 and a series of electrodes 119 which are aligned with apertures 121 in the meshes. The symmetric electrode 118 and the electrodes 119 are biased at the voltage $V_P$.

Figure 2:
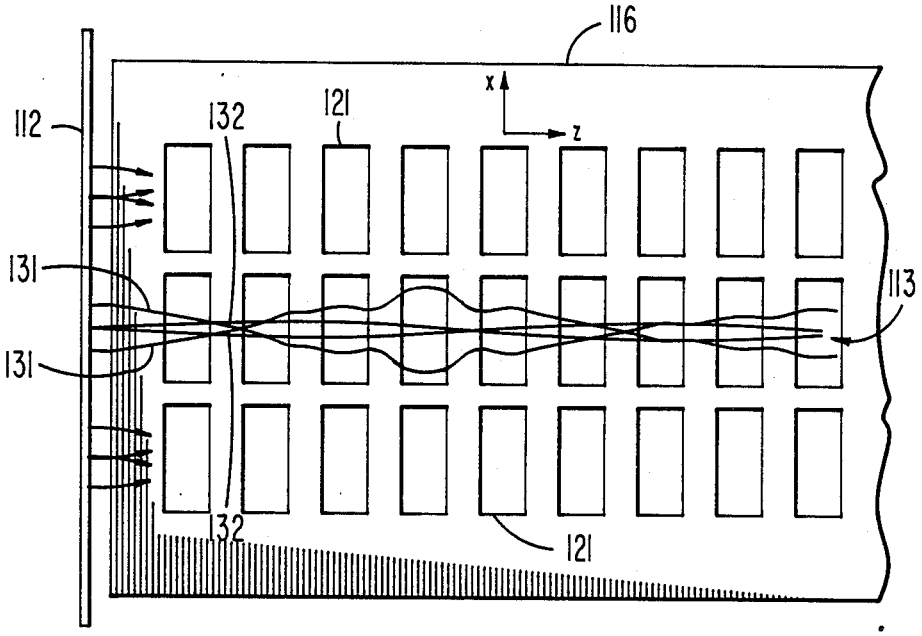
Fig. 2 PRIOR ART
FIG. 2 is a plan view showing the beam configuration in the X-Z, or lateral plane, for prior art beam guide meshes.

FIG. 2 is a top view of the mesh 116 of FIG. 1. For purposes of the following discussion the x, y and z axes of FIGS. 1 and 2 are referred to as lateral, vertical and longitudinal, respectively. Three columns of apertures 121 extend longitudinally along the z axis. Accordingly, three independent electron beams can be simultaneously propagated and a color display formed. Only one aperture column is needed for a monochrome display. Each aperture in a given column, along with the metal bar which separates it from the preceding aperture in the same column, forms one period of the beam guide structure. In the meshes of FIGS. 1 and 2 the apertures 121 have the same dimensions as the apertures in the propagation region, and thus are selected for the optimum propagation of the beams between the guide meshes. Also, the symmetric electrode 118 does not extend into the propagation region. Accordingly, in the propagation region the balancing voltage is applied to a focus mesh (not shown) which is spaced much further from the upper mesh 116 than the lower mesh 117 is from the extraction electrodes 119. A higher biasing voltage must therefore be applied to the focus mesh to maintain balanced fields between the guide meshes 116 and 117. However, the dimensions of the apertures 121 under the symmetric electrode 118 are the same as those in the propagation region under the focus mesh and the same potential $V_P$, therefore, must be applied to the extraction electrodes 119 in both regions to avoid an abrupt spatial change in guide focusing strength. The lateral and vertical profiles of the beam 113 injected into the prior art guide depends on the focusing conditions selected for the guide, as discussed hereinafter with reference to FIGS. 7*a* to 8*b*.

Figure 3B:
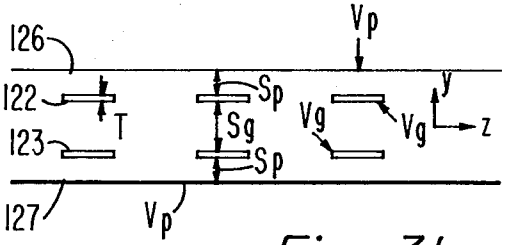
Fig. 3b PRIOR ART
FIGS. 3*a* and 3*b* are a simplified beam guide useful in understanding the operation of a ladder type beam guide structure.
Figure 3A:
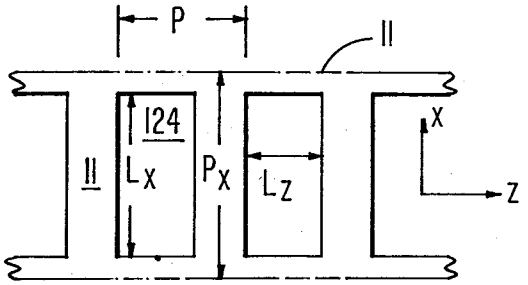
Fig. 3a PRIOR ART

FIGS. 3*a* and 3*b* show the essential features of the prior art beam guide mesh in a simplified form suitable for computer modeling. Two identical ladder-mesh electrodes 122 and 123 are identical to the mesh 116 shown in FIG. 2. FIG. 3*a* depicts a column of apertures 124 which is identical to one of the columns of uniform apertures 121 in FIG. 2. The meshes 122 and 123, have a thickness T, are separated by a distance $S_g$ in the vertical y-direction, and are biased at a potential $V_g$. A pair of continuous electrodes 126 and 127 is arranged at a spacin $S_p$ outside the guide meshes 122 and 123. The electrodes 126 and 127 are biased at a potential $V_p$, which is higher than $V_g$. Apertures 124 in the meshes have a longitudinal z dimension and a lateral x dimension denoted by $L_z$ and $L_x$, respectively. The periodicity in the z-direction is p.

U.S. Pat. No. 4,088,920 to W. W. Siekanowicz, et al. describes how electric fields, which are produced when the electrodes 126 and 127 are biased at a potential $V_p$, penetrate the apertures 124 in the guide meshes 122 and 23 to produce vertical and lateral force gradients on electrons traveling near the z-axis midway between the meshes. In the paraxial regions beneath the apertures, the vertical forces on the electrons are away from the axis (divergent) while the lateral forces are toward the axis (convergent). In the alternate regions beneath the metal bars of the guide meshes 122 and 123, the vertical forces are convergent while the lateral force largely vanishes. As a consequence, electrons traveling near the axis in the z-direction, experience lateral forces which alternate from convergent to neutral with a convergent spatial average. The same electrons also experience vertical forces which alternate from divergent to convergent, with a divergent spatial average. The regions beneath the guide mesh apertures 124 where the vertical force is divergent, however, exhibit a higher electrostatic potential, which imparts a larger z-component of velocity to the electrons within these regions.

As explained by J. R. Pierce in "Theory and Design of Electron Beams", D. Van Nostrand Company, Inc., New York (second edition) 1954, pages 194 to 201, the electrons in an electrostatic periodic guide spend less time in the divergent force of a high potential region than they do in the lower potential of a convergent force region. Consequently, the time-averaged vertical force on an electron traversing many periods is convergent when the fluctuation in z-velocity is sufficiently large.

The lateral forces, which have a convergent spatial average, also have a slightly less convergent time average. Pierce also describes the transverse motion of electrons in a periodic force field, in the absence of significant space charge forces, as a sinusoidal oscillation about the axis having a spatial wavelength λ extending over a number of guide periods. Pierce further distinguishes between first-order and second-order periodic focusing structures. The first-order comprises a region of convergent force followed by a region of no force, in one period. The second-order contains a region of convergent force alternating with a region of equally strong divergent force in a single period. The time-averaged focusing force of a first-order structure is linearly proportional to the convergent force of an individual period. In a second-order structure, stronger individual lenses are required in each period to achieve the same level of time-average focusing. It will be appreciated, from the discussion of the Siekanowicz patent, that the ladder-mesh beam guide provides a first-order confinement structure in the lateral x-direction, and a mixture of first-order divergence and second-order confinement in the vertical y-direction. Accordingly, the local lateral forces associated with a single period in the ladder-mesh guide need not be as strong as the local vertical forces in that period to achieve a comparable degree of confinement. As a consequence, the $L_x$ dimension of the apertures 124 in FIG. 3*a* is larger than the $L_z$ dimension. The aperture edges, which are associated with the x-directed forces, thus can be arranged substantially further from the center of the propagating electron beam, and thereby decrease the influence of the edges on the beam.

The electrostatic potential V near the z-axis of the prior art ladder-mesh beam guide with uniform aperture dimensions shown in FIGS. 3*a* and 3*b* can be approximated for design purposes by the mathematical expression:

$$V(x,y,z)=V_1(x,y)-V_2(x,y)\cos(2\pi z/p), \quad (1)$$

where the longitudinal variation is expressed wholly by the $\cos(2\pi z/p)$ term, and the transverse variations are contained wholly in the $V_1$ and $V_2$ functions. $V_1$ and $V_2$ have even symmetry in both x and y. The z=O origin in this representation is under a bar where the potential is lowest. As is well known, in the absence of significant space charge in the electron beam, the potential expression V(x,y,z) is a solution of the Laplace equation for electrostatic fields:

$$(\partial^2 V/\partial x^2+\partial^2 V/\partial y^2+\partial^2 V/\partial z^2=0. \quad (2)$$

Along the beam guide axis where x=0 and eq. (1) reduces to the simple form $$V(0,0,z)=V_o[1-\epsilon\cos(2\pi z/p)], \quad (3)$$

where:

$$V_o \equiv V_1(0,0)$$

signifies the spatial mean of the axial potential, and $$\epsilon \equiv V_2(0,0)V_1(0.0)$$

denotes the relative fluctuation of the axial potential about its mean value as the z-coordinate moves from points beneath a guide mesh bar to points beneath a guide mesh aperture. The parameter $\epsilon$, as will be explained later, provides an important quantitative measure of the focusing strength of a beam guide. This parameter depends on both the geometry of the beam guide electrodes, and the potentials applied to the electrodes.

The effects of electrode dimensions and applied potentials on vertical focusing strength are known to those skilled in the art and are fully described in an article entitled "Electrostatic Focusing of an Electron-Sheet Beam in a Symmetric Planar Structure" by B. J. Udelson, pages 241–276, International Journal of Electronics, 1966 Vol. 21, No. 3. Methods are described therein for estimating the quantities $V_o$ and $\epsilon$ in eq. (3) from the geometry and the boundary potentials. Udelson further shows that in the absence of any significant lateral confining forces, the long wavelength period $\lambda_y$ of the vertical motion of paraxial electrons is related to the axial potential in the beam guide through the approximate expression:

$$p^2/\lambda_y \cong \epsilon^2 4 \quad (4)$$

where p is the previously defined z-period of the guide structure. The quantities being equated in eq. (4) are proportional to the time-average of the vertical confining force. The fact that the confinement depends only on the second power of $\epsilon$ arises from the fact that the spatial average of the local vertical forces is zero when the lateral forces are absent. Consequently, the two-dimensional beam guide analyzed by Udelson is an example of purely second-order confinement, in Pierce's terminology.

For the prior art ladder-mesh beam guides of FIGS. 1, 2, 3*a* and 3*b*, lateral confinement of the electrons is an important function in addition to the vertical confinement analyzed by Udelson. In these guides, the lateral and vertical components of the electron motion in the paraxial region are largely uncoupled. Accordingly, the lateral and vertical undulations about the z-axis have independent long wavelengths denoted by $\lambda_x$ and $\lambda_y$, respectively, and may be satisfactorily approximated by the expressions $$(p/\lambda_x)^2=\epsilon\epsilon_\infty/4, \quad (5)$$

and $$(p/\lambda_y)^2=\epsilon(\epsilon-\epsilon_\infty)/4. \quad (6)$$

The new parameter $\epsilon_\infty$ is the value of the axial voltage fluctuation ratio $\epsilon$ for which $\lambda_y$ becomes infinite, and below which the time-average vertical forces become divergent. Note that the term $\epsilon\epsilon_\infty$, which measures the divergent component of the vertical confinement in eq. (6), is identical to the strength of the convergent lateral focusing in eq. (5). The parameter $\epsilon_\infty$, therefore, provides a useful measure of the relative strength of the lateral confinement, which is obtained at the expense of vertical confinement forces. The value of the parameter $\epsilon_\infty$ depends only on the geometry of the beam guide, whereas values for $\epsilon$ and $V_o$ in eq. (3) depend on both the geometry and the potentials applied the electrodes.

Figure 4:
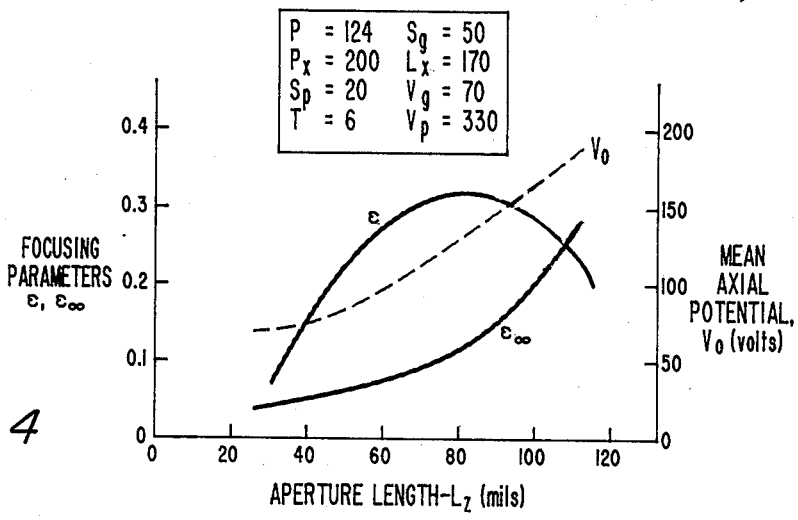
FIGS. 4, 5 and 6 show the relationship of aperture dimensions and focusing strength.
Figure 5:
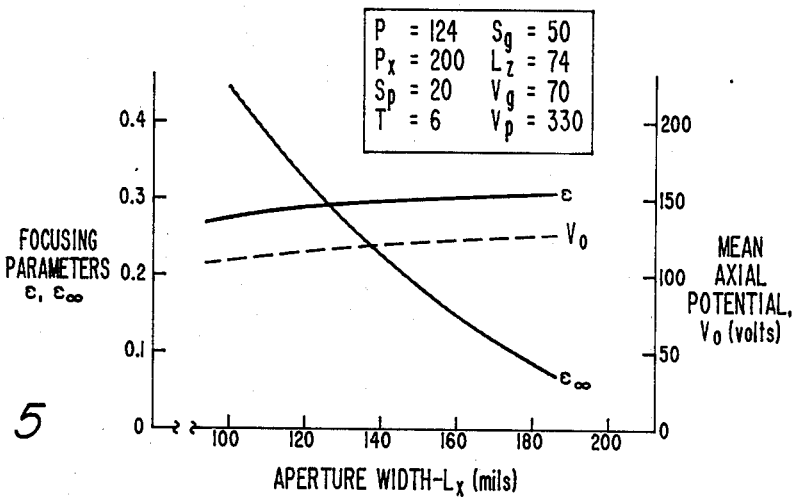
Figure 6:
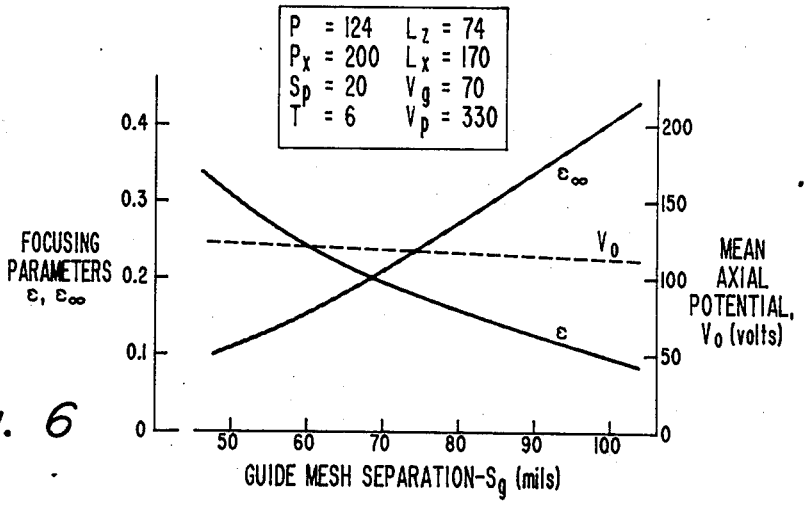

It will be appreciated that the task of optimizing the design of a beam guide requires that the relationships between the focusing parameters, the geometry, and potentials be clearly understood. As stated above, and as described in the article by B. J. Udelson, the characteristics of ladder type guide meshes can best be investigated by computer modeling. FIGS. 4, 5, and 6 are plots of the results of such modeling using the simplified structure shown in FIGS. 3*a* and 3*b* and using the parameters associated with the FIGURES. In these FIGURES $\epsilon$ and $\epsilon_\infty$ are related to the focusing strengths by equations (5) and (6). The mean axial potential $V_o$ is the spatial average of potential along the z-axis midway between the meshes 122 and 123, while $\epsilon$ is the relative fluctuation in the axial potential as the z-coordinate passes alternately under apertures 124 and the bars between the apertures, as expressed in equation (3). FIGS. 4, 5, and 6 show the results of systematically varying the aperture length $L_z$, the aperture width $L_x$, and the guide-mesh separation $S_g$ while the z-period p, the x-period $p_x$, the mesh thickness T, the mesh to electrode spacing $S_p$, the applied voltages $V_g$ and $V_p$ remain fixed.

In FIG. 4, the vertical focusing strength $\epsilon(\epsilon-\epsilon_\infty)$ reaches a peak when the aperture length $L_Z$ is appproximately 70% of the Z-period P of the guide. The critical value $\epsilon_\infty$ required to obtain y-directed confining forces increases monotonically with $L_z$, as does the mean axial potential. The vertical focusing is strongest near $L_z=74$ mils, a typical aperture value for the propagation region in the prior art. Lateral focusing $\epsilon\epsilon_\infty$ initially increases with $L_z$, but tends to saturate for the larger values.

In FIG. 5, the aperture width $L_x$ is varied about a value of 170 mils, which is a typical value for the propagation region in the prior art. Note that the potential fluctuation $\epsilon$ and the mean axial potential $V_o$ are relatively insensitive to variations in $L_x$. However, the lateral focusing parameter $\epsilon_\infty$ is very sensitive to changes in the aperture width $L_x$.

In FIG. 6, the guide mesh separation $S_g$ is increased from a typical value of 50 mils. The balancing electrodes 126 and 127 are moved with the guide meshes 122 and 123 so that the separation $S_p$ remains constant. The resulting mean axial potential $V_o$ has a relatively constant average; the fluctuations decrease with increasing $S_g$, as signaled by the decline in $\epsilon$. The lateral focusing parameter $\epsilon_\infty$ increases markedly along with increases in the mesh spacing $S_g$.

The graphs of FIGS. 4, 5, and 6 show the relationship of the focusing parameters $\epsilon$ and $\epsilon_\infty$ and the guide mesh geometry dimensions $L_x$, $L_z$, and $S_g$. As previously stated, $\epsilon$ and the mean axial potential $V_o$ also depend on the applied potentials $V_g$ and $V_p$. Equations (7) and (8) below describe these relationships:

$$V_o=V_g+a(V_p-V_g), \tag{7}$$

and $$\epsilon=b(V_p-V_g)/V_o, \tag{8}$$

where the proportionality constants a and b depend on the beam guide geometry. Separate graphs of the constants a and b are not needed because all the parameters in eqs. (7) and (8) are shown in FIGS. 4, 5 and 6. Equations (7) and (8) can be solved for a and b, respectively, and values from FIGS. 4, 5 and 6 inserted to yield:

$$a=V_o-70/260, \tag{9}$$

and $$b=\epsilon V_0/260 \tag{10}$$

Evaluation of a and b for particular values of $L_x$, $L_z$, and $S_g$, requires only the substitution of the corresponding values of $\epsilon$ and $V_o$ from the graphs into equations (9) and (10). The graphs of FIGS. 4, 5 and 6, along with the equations (5) through (10), enable one to quantitatively evaluate the tradeoffs between geometry dimensions $L_x$, $L_z$, $S_g$, and the applied potentials $V_g$ and $V_p$ to obtain the desired combinations of optimum lateral and vertical focusing strengths in the various regions of the beam guide.

In FIGS. 1 and 2, the essential characteristics of the injected beam in the prior art are conveniently visualized by calculating the trajectories, or ray paths, of electrons having selected initial conditions spanning the range of positions and thermal velocities at the cathode. Extreme principal rays are denoted as those paths which leave the cathode perpendicular to the cathode surface, and which bound the majority of the emitting region. Extreme thermal rays are denoted as paths leaving the cathode surface at $x=0$, $y=0$, but at angles with respect to the cathode surface. These rays characterize the thermal energy spread of the emitted beam. In FIG. 1, a negative potential on the modulating electrode 111 and the positive potential $V_g$ on the guide meshes 116 and 117 form a strong positive (convergent) lens in front of the guide mesh opening 114. The two principal rays 128 enter the guide region 114 with large vertical velocity components. The thermal rays 129 leaving the cathode 112 are confined by the lens and diverge very little. The vertical focusing conditions in the beam guide must be made strongly confining in order to avoid interception of the principal rays 128 by the second bars 116*a* and 117*a* of the guide meshes. In the prior art device of FIG. 1 uniform aperture dimensions are used for the entire guide mesh, and therefore the vertical focusing conditions remain strong throughout the beam guide.

Figures 7A, 7B, 8A, 8B:
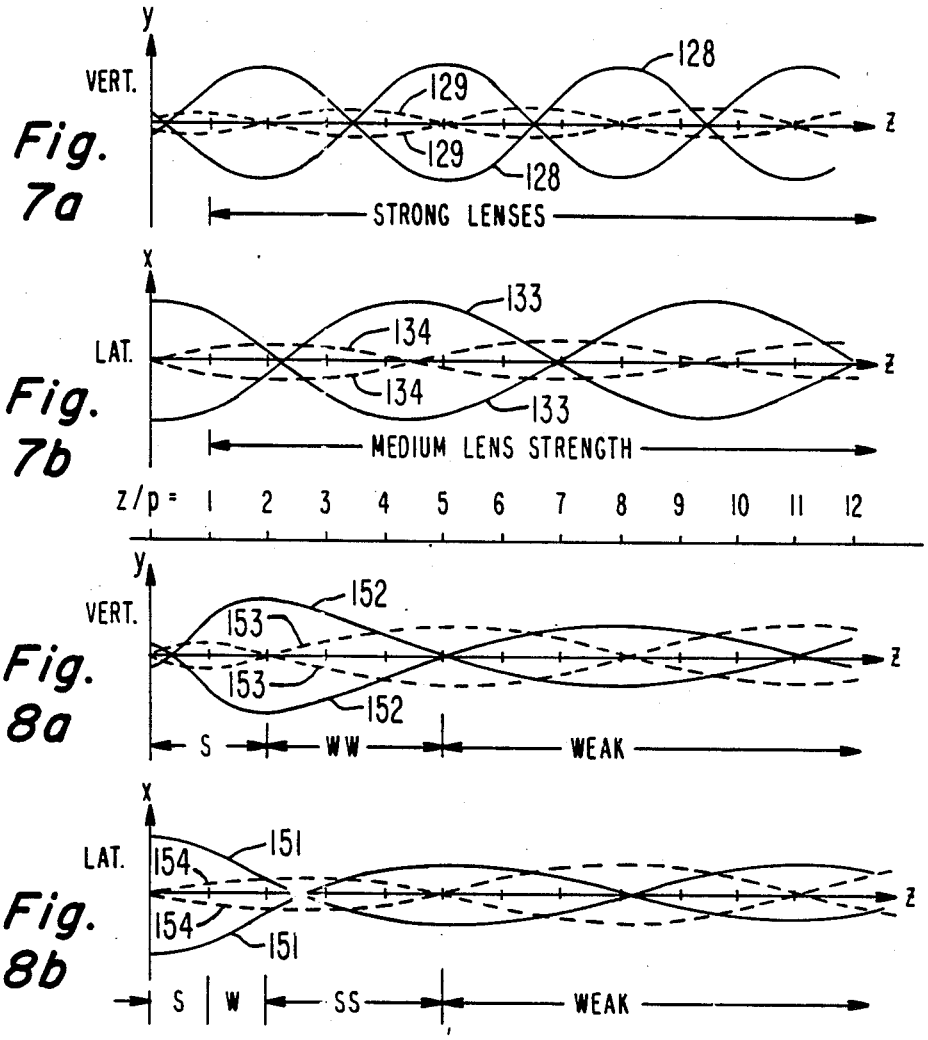
FIGS. 7*a* and 7*b*, respectively, show the vertical and lateral spatial trajectories for prior art beam guides.
FIGS. 8*a* and 8*b*, respectively, show the vertical and lateral spatial; trajectories for beam guides utilizing the present invention.

FIG. 7*a* is a simplified diagram of the vertical ray paths for a plurality of periods; small amplitude ripples are omitted for clarity. The numbers 1 through 12 between FIG. 7*b* and FIG. 8*a* designate the z-axis periodicity of the beam guide structure of FIGS. 1 and 2, and are applicable to FIGS. 7*a*, 7*b*, 8*a* and 8*b*.

In FIG. 7*a*, the result of the strong vertical focusing throughout the beam guide results in a larger amplitude for the principal rays 128 than for the thermal rays 129. This is an inefficient condition since, ideally, the principal rays and the thermal rays are focused to a common amplitude of intermediate value.

In FIG. 2, the lateral aspects of the beam 113 are shown. Because of the construction of the modulator, the principal rays 131 are focused toward the longitudinal axis of the beam guide as the rays leave the cathode 112. The inward velocity of the principal rays 131 is greater than the outward velocity of the thermal rays 132 as the electrons enter the space 114 between the guide meshes 116 and 117. Consequently, the uniformly convergent lateral focusing of the beam guide produces larger amplitudes for the extreme principal rays 131 than for the thermal rays 132.

FIG. 7*b* is a simplified diagram of the lateral ray paths to the same scale as the vertical rays in FIG. 7*a*; again small amplitude ripples are omitted for clarity. Tne combination of applied potentials and aperture dimensions in the prior art typically produces stronger vertical confinement than lateral confinement. Hence, the vertical long wavelength in FIG. 7*a* is shorter than the lateral wavelength in FIG. 7*b*. Also, the lateral principal rays 133 have a larger amplitude than the thermal rays 134, a condition which results in inefficient operation. Additionally, the lateral principal rays 133 first cross the z axis in FIG. 7*b* near the same z-position that the vertical principal rays 128 reach the first maximum in amplitude. When the ratio of potentials $V_p/V_g$ is raised to improve the confinement of the vertical principal rays, the lateral forces are also increased. The increased lateral force causes the lateral principal rays 133 to initially cross the z axis at steeper angles, to thereby increase the subsequent amplitude of the rays. Accordingly, in the prior art devices, the focusing potentials and the guide mesh geometry are selected to form a compromise between maximized electron injection and optimum propagation through the beam guide.

THE PREFERRED EMBODIMENT

Figure 9:
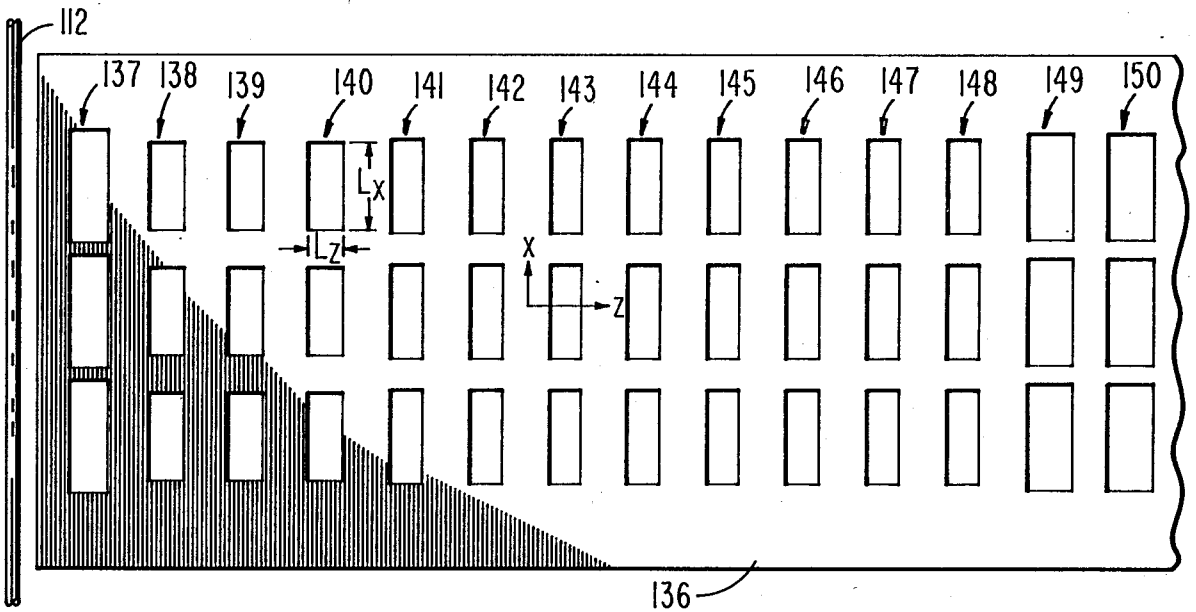
FIG. 9 is a preferred embodiment of one guide mesh.

With the present invention, focusing of an injected electron beam in either the vertical or the lateral direction, can be tailored by strategically selecting differing $L_z$ and $L_x$ dimensions in accordance with the optimum focusing strengths required for particular regions of the meshes. FIG. 9 is a preferred embodiment of a guide mesh structure 136 in which the $L_z$ and $L_x$ dimensions of the apertures in periods 137 to 150 are selected for optimum focusing for various purposes. Two identical guide meshes 136 occupy the same vertical positions as the prior art guide meshes 116 and 117 in FIG. 1. In FIG. 9, there are three columns of apertures in each mesh, and each column defines a guide along which an electron beam propagates. Each column is divided into periods by the apertures 137 to 150 and the separating metal bars. In a first focusing region a selected number of periods have aperture dimensions are chosen to confine the beam vertically with minimal lateral force. In a second focusing region the aperture dimensions for a subsequent number of periods are selected to arrest the lateral beam growth while the vertical amplitude drifts into a more compact size. In another set of periods, for a third focusing region immediately preceding the propagation section, the aperture dimensions are selected to duplicate the focusing conditions in the propagation section of the beam guide. The apertures in the propagation section have uniform sizes and are chosen to give comparable lateral and vertical focusing strengths when operated with weakly confining applied potentials. The $L_z$ dimension for apertures in the propagation region is selected so that a relatively low balancing potential is required for the extraction electrodes.

In FIG. 9, the portion of the guide mesh 136 between the cathode 112 and the propagation region, which begins at aperture 149, is beneath an electrode vertically positioned identically to the position of the symmetric electrode 118 of FIG. 1. This electrode is biased at a balancing potential Vp, which preferably is higher than the balancing potential utilized in the propagation region.

As has been described, maximization of electron injection from the cathode 112 to the beam guide requires strong focusing in the vertical y-direction and weak focusing in the lateral x-direction at the first row of apertures 137. Accordingly, the $L_x$ dimension is as large as the separation between the columns of apertures permits. A high value of balancing voltage $V_p$ produces a strong vertical lens when the $L_z$ dimension is slightly less than the corresponding dimension of apertures in the propagation region. A first plurality of periods have dimensions resulting in weak focusing in the vertical direction and strong focusing in the lateral direction. Accordingly, for a plurality of periods immediately following row 137, the $L_x$ dimension is decreased from that of the corresponding dimension in the propagation region. The $L_z$ dimension is also decreased, and preferably is less than that of period 137. Typically, 2 to 4 periods e.g. periods 138 and 139, or 138 to 141, are designed to maximize lateral beam confinement. In the preferred embodiment the three periods 138 to 140 are used. The strong lateral focusing shapes the beams such that they are suitable for propagation in the remainder of the beam guides. The $L_x$ and $L_z$ dimensions for a plurality of periods, for example, periods 140 to 148 or 142 to 148, are selected to duplicate the focusing conditions in the propagation section. In the preferred embodiment the eight periods 141 to 148 are used. The $L_x$ dimension is smaller than the corresponding dimension in the propagation region and greater than that in the strong lateral focusing region. The $L_z$ dimension is smaller than the corresponding dimension in the propagation region and comparable to that in the weak vertical focusing region. As explained previously, the balancing potential $V_p$ is higher in periods 141 to 148 than in the propagation region which begins at period 149 and continues to the end of the beam guide. Accordingly, the aperture dimensions in periods 141 to 148 can be smaller than the corresponding dimensions in the propagation region, while duplicating the focusing conditions of the propagation region.

Examplary dimensions which can be used are shown in Table I, in which all dimensions are in mils.

TABLE I

| | | | % of Propagation Section Dimensions | |
|---|---|---|---|---|
| Periods | Lz | Lx | Lz % | Lx % |
| 1 | 62 | 180 | 84% | 105% |
| 2–4 | 50 | 130 | 67% | 76% |
| 5–12 | 50 | 150 | 67% | 88% |
| Propagation | 74 | 170 | | |

FIG. 8*a* and FIG. 8*b*, respectively, show the vertical spatial trajectories and the lateral spatial trajectories when the apertures for the first twelve periods are dimensioned for different focusing conditions in accordance with the invention. The numbers 1 through 12 between FIGS. 7*b* and 8*a* designate the beginning of each z-axis period of the beam guide structure of FIG. 9 and are applicable to FIGS. 7*a*, 7*b*, 8*a* and 8*b*. Thus, 1 indicates the center of the bar between aperture 137 and cathode 112 of FIG. 9, and designates the beginning of the first period; 2 indicates the center of the bar between apertures 137 and 138 and designates the beginning of the second period, etc. When the electrons enter the space 114 between the first bar of the mesh 136 and the mesh beneath it, the lateral principal rays 151 in FIG. 8*b* are bending toward the center because of the construction of the modulator. At the same point the vertical principal rays 152 have crossed over and are diverging from the axis. Aperture 137 in FIG. 9 has an enlarged lateral dimension $L_x$ and accordingly in the first period the beam is weakly focused in the lateral direction and strongly focused in the vertical direction, as shown in FIG. 8*b* and FIG. 8*a*, respectively. Thus, the outward growth of the vertical principal rays 152 is arrested in the first period, and the rays are inclined toward the axis at a shallow angle. The strong vertical focusing in the first period has little effect on the vertical thermal rays 153 in FIG. 8*a* because the rays cross over near the axis and begin to diverge. The weak lateral focusing in the first period adds little lateral velocity to either the lateral principal rays 151 or the lateral thermal rays 154.

The focusing for periods 2 through 4 is primarily influenced by apertures 138 through 140 of FIG. 9. These apertures are dimensioned for very strong (SS) lateral focusing and for very weak (WW) vertical focusing. The $L_x$ dimension of those apertures therefore is smaller than it is for the propagation region. The $L_z$ dimension also is slightly reduced. The strong lateral focusing arrests the divergence of the principal rays 151 after they cross over in the lateral direction, and substantially limits the ultimate peak amplitude. The lateral thermal rays 154 are in a relatively low force region near the axis, and are bent into a relatively shallow crossover near the fifth bar. In the vertical direction the principal rays 152 in periods 2 through 4 are very weakly focused and therefore form a shallow crossover near the bar at the beginning of period 5. The thermal rays 153 expand to moderate amplitude in these three periods.

Focusing for periods 5 through 12 is affected by aperture rows 141 through 148. These apertures are dimensioned to duplicate the focusing conditions for optimum beam propagation. The dimensions of these apertures are different from the dimensions of apertures 149 and 150 because the symmetric mesh 118 of FIG. 1 does not extend the full length of the guide meshes, and because symmetric mesh 118 is biased at a higher balancing potential $V_p$ than is used in the propagation region. Accordingly, optimization of the beam focusing requires different aperture sizes until the beam 113 passes from beneath the symmetric mesh 118 at aperture row 149 of FIG. 9. As shown in FIG. 8*a* and FIG. 8*b*, focusing in both the vertical and lateral directions is weak for periods 5 through 12 and thus the amplitudes of the principal and thermal rays in both directions are substantially equal and the propagation efficiency is maximized. Accordingly, with the invention the optimum focusing for the otherwise competing conditions of maximum beam current injection, control over the lateral dimensions of the beam, and beam shaping with optimum weak confinement for propagation purposes are all obtainable by the aperture variation technique described herein. Additionally, these marked advantages are achievable by merely changing the artwork utilized to produce the image pattern prior to acid etching the guide meshes. The complexity, and the inherent attendant difficulties, of the additional electrodes required in the Siekanowicz and Gange devices are totally eliminated while substantial operational improvements are realized.

What is claimed is:

1. In a beam guide structure for a flat panel display device having a cathode, said beam guide structure having a pair of beam guide meshes spaced along a vertical axis, whereby electrons from said cathode propagate as beams between said guide meshes in a propagation section, each of said meshes including at least one longitudinal column of apertures, each of said apertures having a longitudinal dimension and a lateral dimension substantially normal to said longitudinal dimension, said beam guide structure also including focusing electrodes arranged on both sides of said guide meshes, said focusing electrodes receiving focusing voltages to form electric fields through said apertures and focus electron beams between said guide meshes whereby each of said apertures forms a period of said beam guide structure; an electron injection section arranged between said cathode and said propagation section comprising:

a first focusing region including at least one period having aperture dimensions resulting in strong electron focusing in the direction of said vertical axis; and weak focusing in a direction parallel to said lateral dimension;

a second focusing region including a first plurality of periods having aperature dimensions resulting in weak focusing along said vertical axis, and strong focusing in a direction parallel to said lateral dimension; and a third focusing region including a second plurality of periods having aperture dimensions selected to match focusing in said preopagation section.

2. The electron injection region of claim 1 wherein said at least one period is the first period of said beam guide structure;

said first plurality includes three periods; and said second plurality includes eight periods.

3. The electron injection region of claim 1 wherein said at least one period is the first period of said beam guide structure;

said first plurality includes 2 to 5 periods; and said second plurality includes 7 to 9 periods.

4. In a beam guide structure for a flat panel display device having an electron gun, said beam guide structure having a pair of beam guide meshes spaced along a vertical axis, whereby electrons propagate as beams between said guide meshes in a propagation section, each of said meshes including at least one longitudinal dimension substantially parallel to said longitudinal column and a lateral dimension substantially normal to said longitudinal dimension, said beam guide structure also including focusing electrodes arranged on both sides of said guide meshes, said focusing electrodes receiving focusing voltages to form electric fields through said apertures and focus electron beams between said guide meshes; an electron injection region between said electron gun and said propagation section comprising:

at least one aperture, in the closest proximity of said electron gun, having a lateral dimension larger than the corresponding dimension of the apertures in said propagation section; and a longitudinal dimension smaller than the corresponding dimension of the apertures in said propagation section;

a first plurality of apertures in said column of apertures having dimensions smaller than the corresponding dimensions of the apertures in said propagation section; and a second plurality of apertures in said column of apertures having a longitudinal dimension substantially equal to that of the apertures in said first plurality, and a lateral dimension between that of the apertures in said first plurality and the apertures in said propagation section.

5. The electron injection region of claim 4 wherein the lateral dimension of said at least one aperture is approximately 103% to 107% and the longitudinal dimension is approximately 82% to 86% of that of the corresponding dimensions of the apertures in said propagation section, the lateral dimension of the apertures in said first plurality is approximately 74% to 78% and the longitudinal dimension is approximately 65% to 68% that of the corresponding dimension of the apertures in said propagation section; and the lateral dimension of the apertures in said second plurality is approximately 86% to 90% and the longitudinal dimension is approximately 65% to 69% that of the corresponding dimensions of the apertures in said propagation section.

6. The electron injection region of claim 4 wherein said at least one aperture is the first aperture of said beam guide structure;

said first plurality includes 2 to 5 periods;

and said second plurality includes 7 to 9 periods.

7. The electron injection region of claim 4 wherein said at least one aperture is the first aperture of said beam guide structure;

said first plurality includes three periods; and said second plurality includes eight periods.

* * * * *

UNITED STATES PATENT AND TRADEMARK OFFICE
CERTIFICATE OF CORRECTION

PATENT NO. : 4,672,262

DATED : June 9, 1987

INVENTOR(S) : Wilbur C. Stewart & Leon Joseph Vieland

It is certified that error appears in the above-identified patent and that said Letters Patent is hereby corrected as shown below:

Column 5, line 55: The equation should read $$\varepsilon \Xi \frac{V_2(0,0)}{V_1(0,0)}$$

Column 6, line 14: the equation should read $$p^2/\lambda_y \cong \varepsilon^2/4 \qquad (4)$$

Column 9, line 25 delete "are"

Signed and Sealed this

Sixth Day of February, 1990

*Attest:*

JEFFREY M. SAMUELS

*Attesting Officer* *Acting Commissioner of Patents and Trademarks*